US009149942B2

(12) United States Patent
Van Der Meer

(10) Patent No.: US 9,149,942 B2
(45) Date of Patent: Oct. 6, 2015

(54) SHAVING APPARATUS

(75) Inventor: Mattheus Jacobus Van Der Meer, Drachten (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 1690 days.

(21) Appl. No.: 10/565,931

(22) PCT Filed: Jul. 16, 2004

(86) PCT No.: PCT/IB2004/051236
§ 371 (c)(1),
(2), (4) Date: Jan. 20, 2006

(87) PCT Pub. No.: WO2005/007354
PCT Pub. Date: Jan. 27, 2005

(65) Prior Publication Data

US 2008/0052910 A1 Mar. 6, 2008

(30) Foreign Application Priority Data

Jul. 23, 2003 (EP) ..... 03102268

(51) Int. Cl.
*B26B 19/38* (2006.01)
*B26B 19/28* (2006.01)
*B26B 19/10* (2006.01)

(52) U.S. Cl.
CPC ..... *B26B 19/28* (2013.01); *B26B 19/10* (2013.01); *B26B 19/105* (2013.01)

(58) Field of Classification Search
CPC ..... B26B 19/102; B26B 19/105
USPC ..... 30/34.1, 43.4–43.6
See application file for complete search history.

(56) References Cited

U.S. PATENT DOCUMENTS

| | | | | | |
|---|---|---|---|---|---|
| 3,213,536 | A | * | 10/1965 | Futterer et al. | 30/34.1 |
| 3,431,643 | A | * | 3/1969 | Miceli | 30/42 |
| 3,690,000 | A | | 9/1972 | Loner | |
| 4,355,464 | A | * | 10/1982 | Bergsma | 30/34.1 |
| 5,052,106 | A | * | 10/1991 | Labrijn | 30/34.1 |
| 5,577,324 | A | * | 11/1996 | Tanaka | 30/43.6 |
| 5,701,673 | A | * | 12/1997 | Ullmann et al. | 30/34.1 |
| 6,317,982 | B1 | | 11/2001 | Andrew | |
| 2001/0003228 | A1 | * | 6/2001 | Van Hout et al. | 30/34.1 |
| 2002/0011003 | A1 | * | 1/2002 | Van Hout et al. | 30/34.1 |

FOREIGN PATENT DOCUMENTS

| | | | |
|---|---|---|---|
| DE | 2028063 | | 7/1971 |
| EP | 0398430 | A1 | 11/1990 |
| EP | 0 406 974 | B1 | 5/1994 |
| GB | 825851 | | 12/1959 |
| JP | 2001149670 | A | 6/2001 |
| JP | 2001232074 | A | 8/2001 |

* cited by examiner

*Primary Examiner* — Kenneth E Peterson

(57) ABSTRACT

A shaving apparatus has at least one shaving head with at least one cutter, a trimmer, and a drive structure including a motor for driving the cutter or cutters and the trimmer. The trimmer is disengageable from the drive structure. At least a portion of the drive structure may be rotated in reverse directions between a first sense of rotation and a second, opposite, sense of rotation. A unidirectional clutch is arranged between the portion of the drive structure of which the sense of rotation is reversible and the cutter or cutters. When the sense of rotation is reversed from the sense of rotation in which the cutter or cutters is driven, the trimmer may be driven without driving the cutter or cutters.

8 Claims, 5 Drawing Sheets

SHAVING APPARATUS

The invention relates to a shaving apparatus.

Such a shaving apparatus is known from European patent application 0 406 974. When the trimmer of this apparatus is activated, the cutters of the shaving heads remain coupled to the drive structure. This entails a number of drawbacks.

Firstly, a substantial portion of the available motor power is consumed by driving the cutters of the shaving heads. This power consumption limits the power available for driving the trimmer. In turn, this limits the frequency with which cutting members of the trimmer can be oscillated at a given amount of available motor power. Such a limitation is undesirable, because trimmers tend to operate more effectively when moving at higher frequencies. Secondly, the power consumed for driving the cutters of the shaving heads while only the trimmer is used, constitutes a waste of energy. This is particularly disadvantageous if the shaver is battery driven, because of the relatively limited amount of energy that can be stored in a battery. Thirdly, the idly moving cutters of the shaving heads cause noise and wear.

In German patent application 2 028 063, a shaving apparatus is described in which the transmission structure comprises a clutch between the motor and the cutter of the shaving head. The clutch and a connecting arm for transferring oscillating movements from a drive shaft to the trimmer are arranged and connected to an operating member, such that the clutch disengages when the connecting arm engages the drive shaft. The clutch may be, for example, a plate clutch or a claw clutch or a coupling member, which engages either a pin projecting from the cutters of the shaving head or a pin projecting from the trimmer. Plate and claw clutches are relatively complicated, and the coupling member is guided during its reciprocating movement by the operating member, which causes drag and wear.

It is an object of the present invention to provide a shaving apparatus of the above-described type in which the problem of drag and noise due to idly moving cutters of the shaving head is solved in a simple manner.

According to the present invention, this object is achieved by providing a shaving apparatus having reversing means. By reversing the sense of rotation of a portion of the drive structure, which is coupled to the cutter or cutters of the shaving head or shaving heads via a unidirectional coupling, the unidirectional clutch either engages, causing the cutter or cutters of the shaving head or shaving heads to be entrained, or disengages, causing the cutter or cutters of the shaving head or shaving heads not to be driven. In the latter condition the trimmer can be driven without driving the cutter or cutters of the shaving head or shaving heads.

Figure 1:
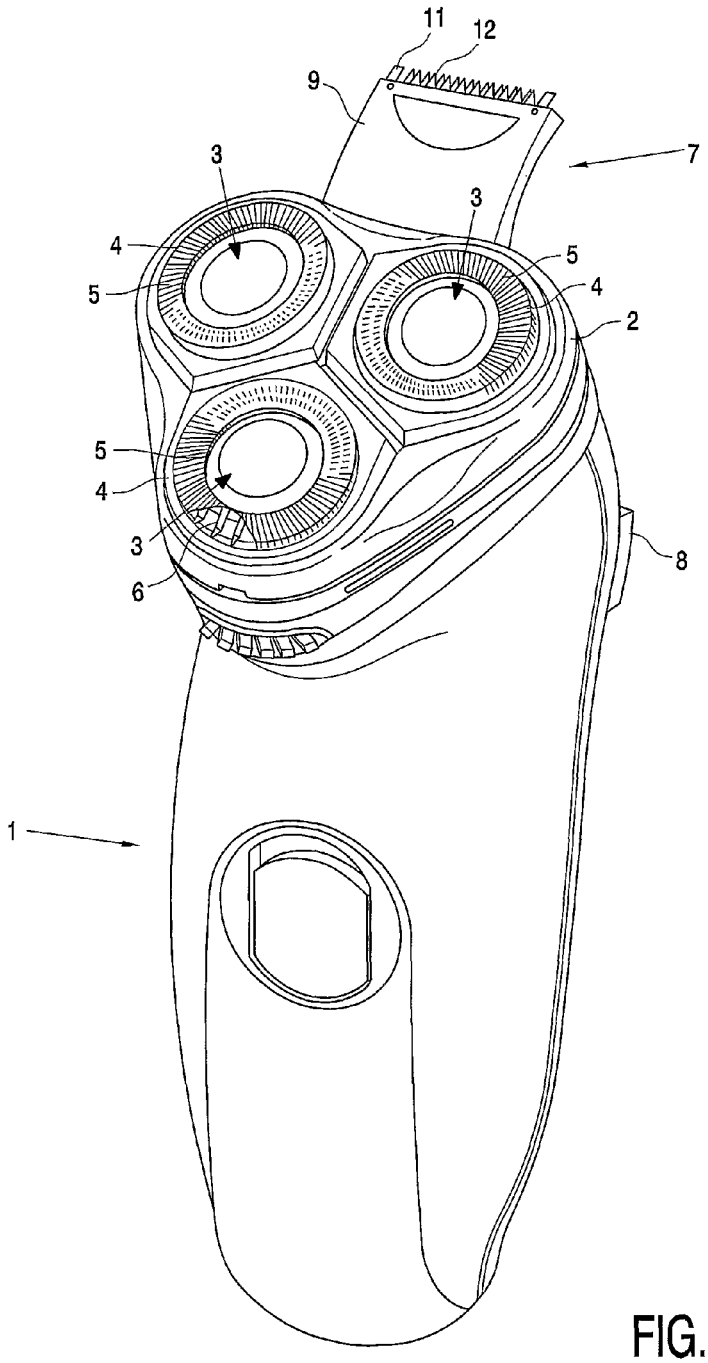
FIG. 1 is a perspective view of an example of a shaving apparatus according to the invention.
Figure 2:
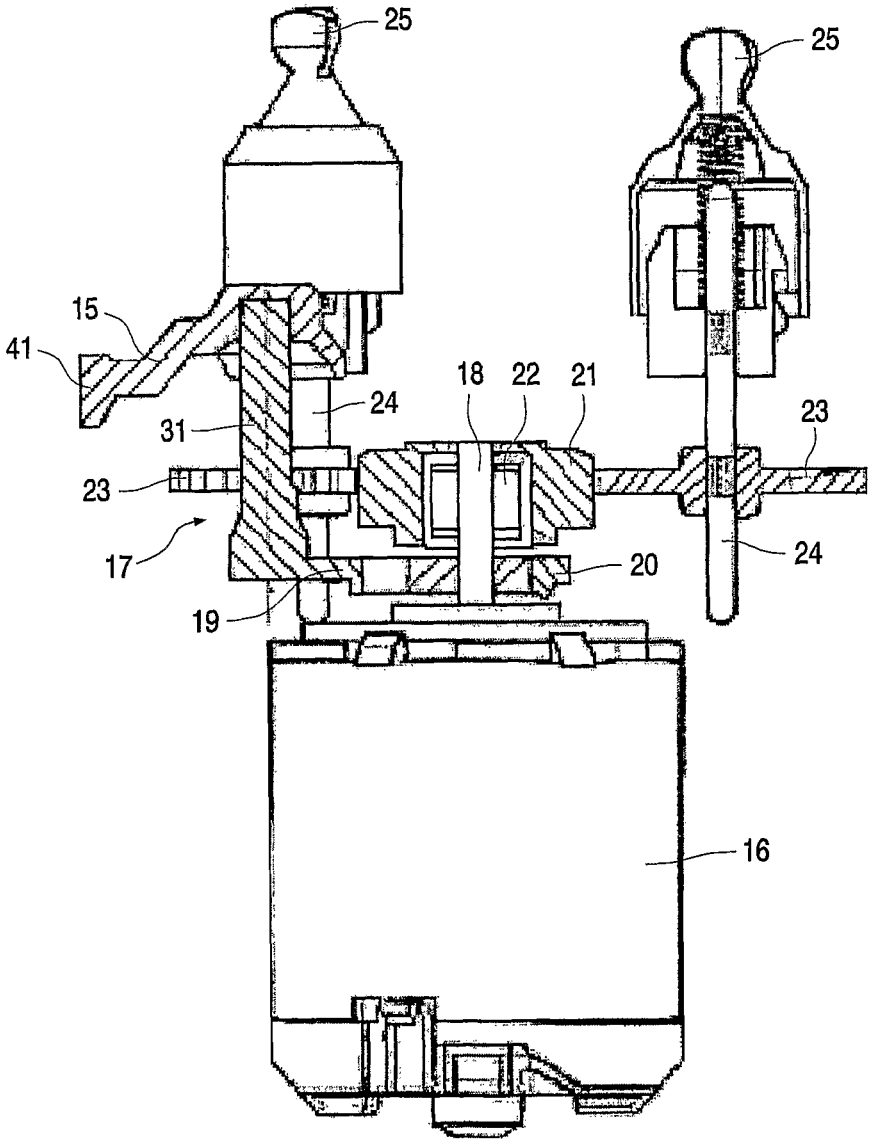
FIG. 2 is a side view, partially in cross-section, of an example of a drive structure of a shaving apparatus according to the invention.
Figure 3:
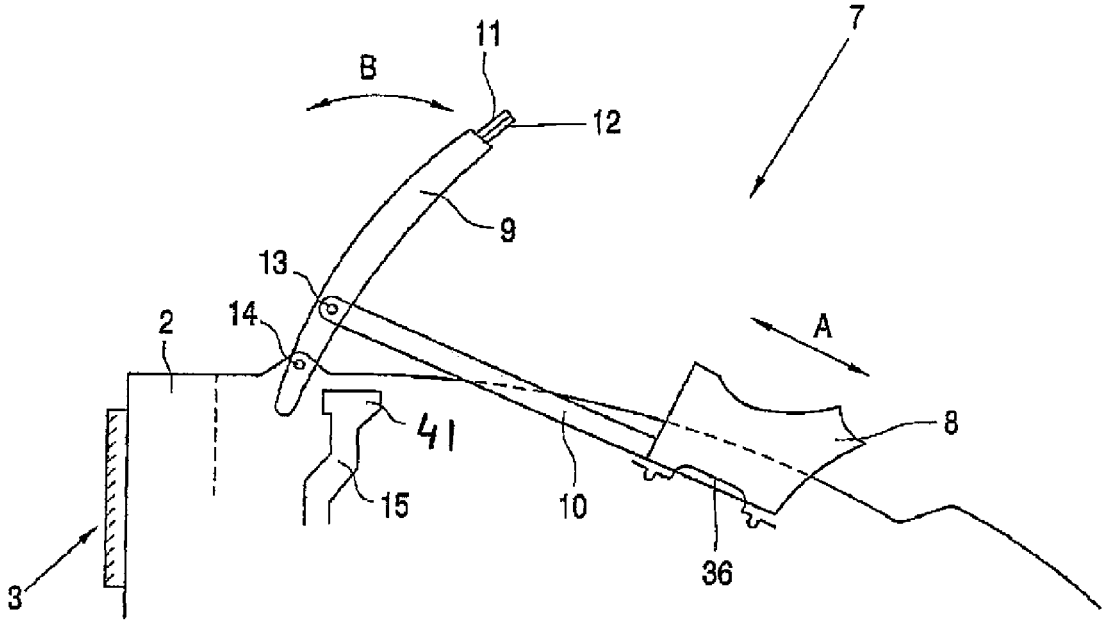
FIG. 3 is a schematic representation in side view of a trimmer of a shaving apparatus according to the invention.
Figure 4A:
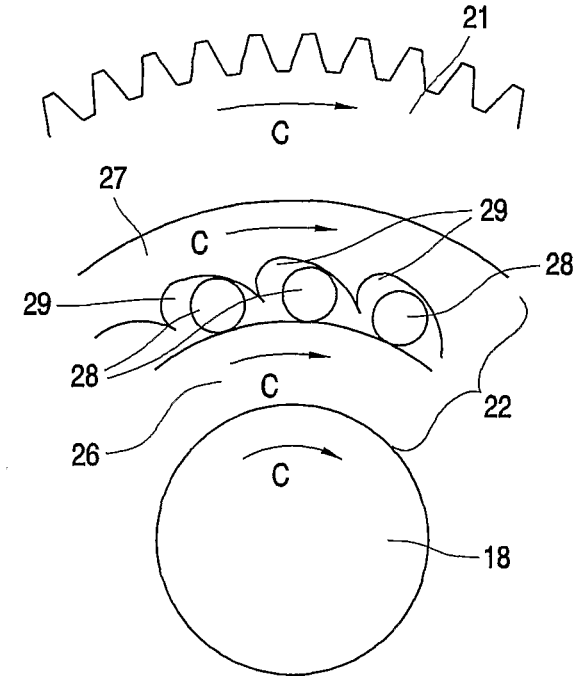
Figure 4B:
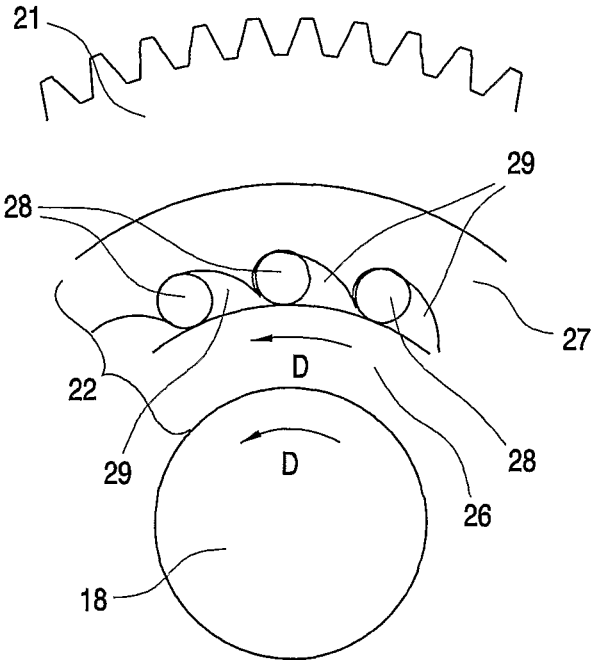
Figure 5A:
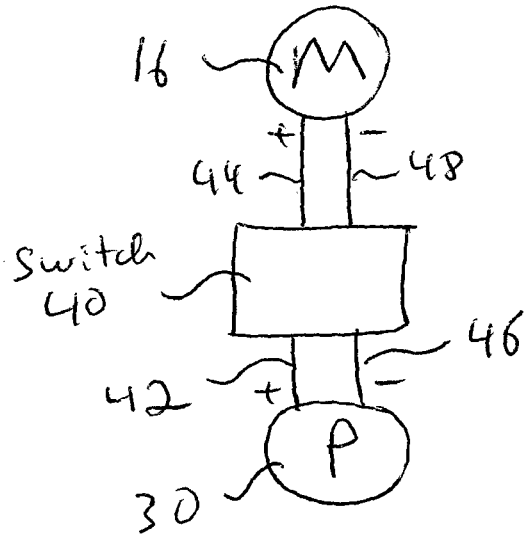
Figure 5B:
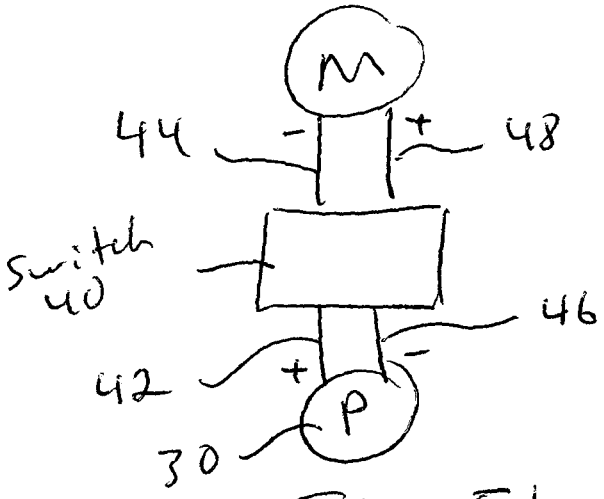

FIG. 4*a* is a schematic partial side view of an example of a unidirectional clutch of the shaving apparatus according to FIGS. 1-3 in engaged condition;

FIG. 4*b* is a schematic partial side view of the clutch of FIG. 4*a* in disengaged operational condition;

FIG. 5*a* is a schematic representation of an electric circuit for reversal of the sense of rotation of the motor of the shown shaving apparatus; and FIG. 5*b* shows the circuit shown in FIG. 5*a* in a condition for causing the motor to rotate in a sense of rotation opposite to that of FIG. 5*a*.

The shaving apparatus 1 according to the example shown in FIG. 1 has a shaving head carrier 2 carrying three shaving heads 3 and a trimmer 7 for trimming hairs of, for example, side-whiskers, a beard, or a moustache.

The shaving heads 3 are each provided with an external hair-cutting member 4 with hair-entry apertures 5 and an internal hair-cutting member comprising a plurality of cutters 6. As is best seen in FIG. 3, the trimmer 7 has an operating member 8 constructed as a sliding button, a holder 9, and a connection element 10 connecting the holder 9 to the sliding button 8. The holder 9 is provided with a fixed hair-trimming member 11 having a row of cutting teeth and a movable hair-trimming member 12 also having a row of cutting teeth. The movable hair-trimming member 12 is movable back and forth relative to the fixed hair-trimming member 11 in the direction of the rows of teeth. The connection element 10 is hinged to the holder 9 at a connection 13. The holder 9 is hinged to the housing at a connection 14. These hinge connections enable the holder 9 to be pivoted in the directions B (FIG. 3) between an operating position projecting from the housing and a retracted position extending along the housing in that the operating member 8 is moved in the directions A. When the holder 9 is in an operating position projecting from the housing, an arm 15 of a drive structure inside the housing of the apparatus 1 is coupled to the movable hair-trimmer member 12. In operation, the movable hair-trimmer member 12 is driven by an end 41 of the arm 15, which moves back and forth in the direction of movement of the movable hair-trimmer member 12 (substantially perpendicularly to the cross-sectional view of FIG. 3). When the holder 9 is in its non-operational, retracted position, the movable hair-trimmer member 12 is disengaged from the end 41 of the arm 15. When the motor 16 is rotating, the end 41 of the arm 15 is still moving back and forth, but the movable hair-trimmer member 12 is not driven because it is disengaged from the drive structure.

In FIG. 2, the drive structure of the apparatus according to FIG. 1 is shown. The drive structure comprises a motor 16 and a transmission structure 17. The trimmer 7 is coupled to a drive shaft 18 of the motor 16 by means of an excentric 20, an arm 19, and the arm 15, the arms 15, 19 being fixedly connected by a shaft 31 that is suspended for rotation about its center line. The shaft 31 is integrally formed with the arm 19. In operation, the excentric 20 causes the arm 19 to pivot about the centerline of the shaft 31. This pivoting movement is transferred to the arm 15, causing its end 41 to move back and forth.

Furthermore, a driven portion of a unidirectional clutch 22 is coupled to the drive shaft 18 to be rotated by the drive shaft 18. A gear wheel 21 is fixed to the driving portion of the unidirectional clutch 22 to be rotated by the driven portion of the unidirectional clutch 22. The gear wheel 21 is connected to stub gear wheels 23, which, fixed to stub axes 24 for driving stubs 25 that engage recesses of the internal hair-cutting members 6 of the shaving heads 3.

FIGS. 4*a* and 4*b* show the unidirectional clutch 22 in more detail. The unidirectional clutch 22 is of a known type and comprises an inner ring 26 connected to the drive shaft 18 and an outer ring 27 connected to the gear wheel 21. Balls 28 are arranged in compartments 29 between the rings 26, 27. When the drive shaft 18 and the inner ring 26 are rotating in the sense of rotation indicated by the arrow C in FIG. 4*a* the balls 28 are clamped between the inner ring 26 and the outer ring 27 owing to the shape of the compartments 29. This clamping effect causes the outer ring 27 of the clutch 22 to be entrained by the inner ring 26, so that the cutters 6 of the shaving heads are driven.

When the drive shaft 18 and the inner ring 26 are rotating in the opposite sense of rotation, indicated by the arrow D in FIG. 4*b*, the balls 28 are not clamped between the inner ring 26 and the outer ring 27 owing to the shape of the compartments 29, but can rotate with only very little friction relative to the inner and outer rings 26, 27. Therefore, if the inner ring 26 is driven in this opposite sense of rotation, the outer ring 27 of the clutch 22 is not entrained, so that the clutch operates in a freewheeling mode and neither the cutters 6 of the shaving heads 3 nor the gear wheels 21, 23 and the stub shafts 24 are driven.

It is noted that many different types of unidirectional clutches may be used in a shaving apparatus according to the invention instead of the above-described clutch 22.

Reference is now made in particular to FIGS. 5*a* and 5*b*, where reversing means, such as a reversing switch 40, as is well known in the art, operable with the operating member 8 of the trimmer 7, for reversing the sense of rotation of the motor 16 are shown. A power source 30 can be connected to the motor 16 via electrical conductors. The reversing switch may include a conductor 36 mounted to the operating member 8 such that, when the operating member 8 moves, the conductor 36 moves along with it.

When the operating member 8 is in a first position, a first pole 42 of the power source 30 is connected through the reversing switch 40 to a first electrical contact 44 of the motor 16, while the other, second pole 46 of the power source 30 is connected to the other, second electrical contact 48 of the motor 16.

Sliding the operating member 8 in one direction brings the operating member 8 into a position where the reversing switch 40 connects the first pole 42 of the power source 30 to the second electrical contact 48 of the motor 16, while the other, second pole 46 of the power source 30 is connected to the first electrical contact 44 of the motor 16, as shown in FIG. 5*b*. The reversing means 40 for reversing the sense of rotation of the motor 16 are integrated in the operating member 8 for putting the trimmer into and out of operation.

In operation, during shaving without the use of the trimmer, the shaving heads 3 are in operation, while the trimmer 7 is in its retracted position. In this operating condition, the drive shaft 18 rotates in the sense of rotation causing the unidirectional clutch 22 to be in the coupled condition (FIG. 4*a*). Although the end 41 of the arm 15 is moved back and forth by the connections via the shaft 31, the arm 19, and the excentric 20, the trimmer is not in operation since the end 41 of the drive structure does not engage the movable hair-trimming member 12. The operating member is then in the position shown in FIG. 5*a*.

If the operating member 8 is moved in a direction A (FIG. 3), towards the shaving head, the trimmer 7 is moved into its operating position and engaged by the drive structure, so that the movable hair-trimming member 12 is driven. At the same time, the motor 16 is reversed, because the operating member 8 is slid so that the reversing switch 40 reverses the connections to the motor 16, as shown in FIG. 5*b*. The reversal of the sense of rotation of the motor 16 causes the unidirectional clutch 22 not to entrain its driving portion, so that the cutters 6 of the shaving heads 3 are not driven.

Inversion of the sense of rotation of the driven part of the unidirectional clutch 22 thus causes the cutters 6 of the shaving heads 3 not to be driven. This constructionally simple measure allows to avoid drag, wear and noise while the movable hair-trimming member 12 of the trimmer 7 is in operation. The shaving heads 3 do not consume power from the motor 16 during operation of the trimmer 7, so that full power is available for the trimmer 7. This allows the hair-trimming member 12 of the trimmer 7 to operate at a higher frequency for a given power of the motor. Preferably, the number of cycles per unit time at which the movable hair-trimming member 12 oscillates is also higher than the number of revolutions per unit time at which the cutter 6 rotates when in operation.

Since the reversal of the sense of rotation is operated in conjunction with putting the trimmer 7 into and out of operation, the reversal of the sense of rotation does not need to be operated separately, but is automatically obtained when the trimmer is put into and out of operation.

The reversing means include switching circuitry for reversing the sense of operation of the motor 16, so that the sense of operation in which the unidirectional clutch 22 is driven can be inverted in a very simple manner. However, other solutions for inverting the sense of rotation in which the unidirectional clutch 22 is driven, such as a reversing gear, are also conceivable.

In the example shown, the portion 15, 18, 19, 41, 31 of the transmission structure 17 for driving the trimmer 7 branches off from a portion 18, 21, 23, 24, 25 of the transmission structure 17 for driving the cutters at the drive shaft 18 that is directly coupled to the motor 16. Branching off the trimmer drive from the cutter drive at a portion of the drive structure directly coupled to the motor allows to drive the trimmer 7 without losses in the gearing between the motor and the cutter or cutters of the shaving head or heads.

In practical use of the apparatus 1, the unidirectional clutch 22 will not be particularly susceptible to wear and tear, since the clutch 22 will act in its coupled mode most of the time.

Having described the invention, many modifications thereto will become apparent to those skilled in the art without deviation from the invention as defined by the scope of the appended claims. In particular, the invention is not limited to shavers with rotating shaving heads, but may also be applied in shavers with oscillating shaving heads driven by a drive structure of which at least one member rotates in operation.

The invention claimed is:

1. A shaving apparatus comprising:

at least one shaving head comprising at least one cutter;

a trimmer;

a drive structure comprising a motor and a transmission structure for driving the at least one cutter and the trimmer;

the trimmer being disengageable from the drive structure;

an operating member configured to move the trimmer between a retracted position and an extended position where the trimmer operates in response to being moved to the extended position;

reversing means for reversing at least a portion of the drive structure between a first sense of rotation and a second, opposite sense of rotation; and a unidirectional clutch between at least said portion of the drive structure of which the sense of rotation is reversible and the at least one cutter;

wherein the reversing means are integrated in the operating member and co-operate with the trimmer for reversing said sense of rotation in response to an action of moving the trimmer between the retracted position and the extended position using the operating member so that when the trimmer is moved to the extended position, the reversing means reverses the sense of rotation to the first sense of rotation for ending operation of the at least one cutter and starting operation of the trimmer, and when the trimmer is moved to the retracted position, the reversing means reverses the sense of rotation to the second sense of rotation for ending operation of the trimmer and starting operation of the at least one cutter.

2. The shaving apparatus according to claim 1, wherein the reversing means comprise switching circuitry for reversing the sense of operation of said motor.

3. The shaving apparatus according to claim 1, wherein a portion of the transmission structure for driving the trimmer branches off from a portion of the transmission structure for driving said at least one cutter at a shaft coupled to be directly driven by the motor.

4. The shaving apparatus of claim 1, wherein the drive structure has transmission ratios for driving the trimmer with a number of cycles per unit time and for driving the at least one cutter of the at least one shaving head with a number of revolutions per unit time, such that said number of cycles per unit time of the driven trimmer is higher than said number of revolutions per unit time of the at least one driven cutter.

5. The shaving apparatus of claim 1 wherein, when the trimmer is in the retracted position, the motor rotates in the second sense of rotation to move the drive structure and disengage the drive structure from the trimmer and wherein, when the trimmer is in the extended position, the motor rotates in the first sense of rotation to move drive structure and engage the trimmer.

6. A shaving apparatus comprising:

at least one shaving head comprising at least one cutter;

a trimmer which is moveable between a retracted position and an extended position, wherein the trimmer operates in response to being moved to the extended position;

a drive structure comprising a motor and a transmission structure for driving the at least one cutter and the trimmer, wherein the trimmer is disengageable from the drive structure;

a reversing device configured to reverse at least a portion of the drive structure between a first sense of rotation and a second, opposite sense of rotation in response to moving the trimmer between the retracted position and the extended position so that when the trimmer is moved to the extended position, the reversing device reverses a sense of rotation to the first sense of rotation for ending operation of the at least one cutter and starting operation of the trimmer, and when the trimmer is moved to the retracted position, the reversing device reverses the sense of rotation to the second sense of rotation for ending operation of the trimmer and starting operation of the at least one cutter; and a unidirectional clutch between at least said portion of the drive structure and the at least one cutter.

7. The shaving apparatus of claim 6, wherein the portion of the drive structure rotates in the second sense to drive the at least one cutter when the trimmer is in the retracted position not engaging a trimmer moving member that moves, and wherein moving the trimmer into the extended position for engaging the trimmer moving member reverses rotation of the portion of the drive structure to a first sense to stop driving the at least one cutter.

8. The shaving apparatus of claim 6 wherein, when the trimmer is in the retracted position, the motor rotates in the second sense of rotation to move the drive structure and disengage the drive structure from the trimmer and wherein, when the trimmer is in the extended position, the motor rotates in the first sense of rotation to move drive structure and engage the trimmer.

* * * * *